US007982153B2

(12) United States Patent
Lin et al.

(10) Patent No.: US 7,982,153 B2
(45) Date of Patent: Jul. 19, 2011

(54) ROTARY COMBINED SWITCH STRUCTURE WITH MULTISTAGE SWITCH FUNCTION

(75) Inventors: Chia-Wei Lin, Taoyuan (TW); Chi-Meng Phang, Taoyuan (TW); Chen-Hong Huang, Taoyuan (TW)

(73) Assignee: Solteam Electronics Co., Ltd., Taoyuan (JP)

( * ) Notice: Subject to any disclaimer, the term of this patent is extended or adjusted under 35 U.S.C. 154(b) by 224 days.

(21) Appl. No.: 12/379,884

(22) Filed: Mar. 4, 2009

(65) Prior Publication Data

US 2010/0147669 A1 Jun. 17, 2010

(30) Foreign Application Priority Data

Dec. 17, 2008 (TW) ..... 97149138 A

(51) Int. Cl.
*H01H 19/20* (2006.01)

(52) U.S. Cl. ..... 200/568

(58) Field of Classification Search ..... 200/568, 200/564–565, 5 R, 5 B; 341/35; 345/184
See application file for complete search history.

(56) References Cited

U.S. PATENT DOCUMENTS 3,951,007 A * 4/1976 Naulin ..... 74/568 R
4,131,771 A * 12/1978 Erickson et al. ..... 200/11 DA
7,148,440 B2 * 12/2006 Gjerde ..... 200/569

* cited by examiner

*Primary Examiner* — Edwin A. Leon
*Assistant Examiner* — Vanessa Girardi
(74) *Attorney, Agent, or Firm* — Roger H. Chu

(57) ABSTRACT

A rotary combined switch structure with multistage switch function includes a casing unit, a switch unit and a rotary unit. The casing unit has a casing, a first opening formed on a top side of the casing and a second opening formed on a bottom side of the casing. The switch unit is disposed under the casing. The rotary unit has a rotary body. The rotary body has a top portion passing through the first opening and exposed above the casing, and the rotary body has a bottom portion passing through the second opening and exposed under the casing in order to selectably turn on or turn off the switch unit.

13 Claims, 8 Drawing Sheets

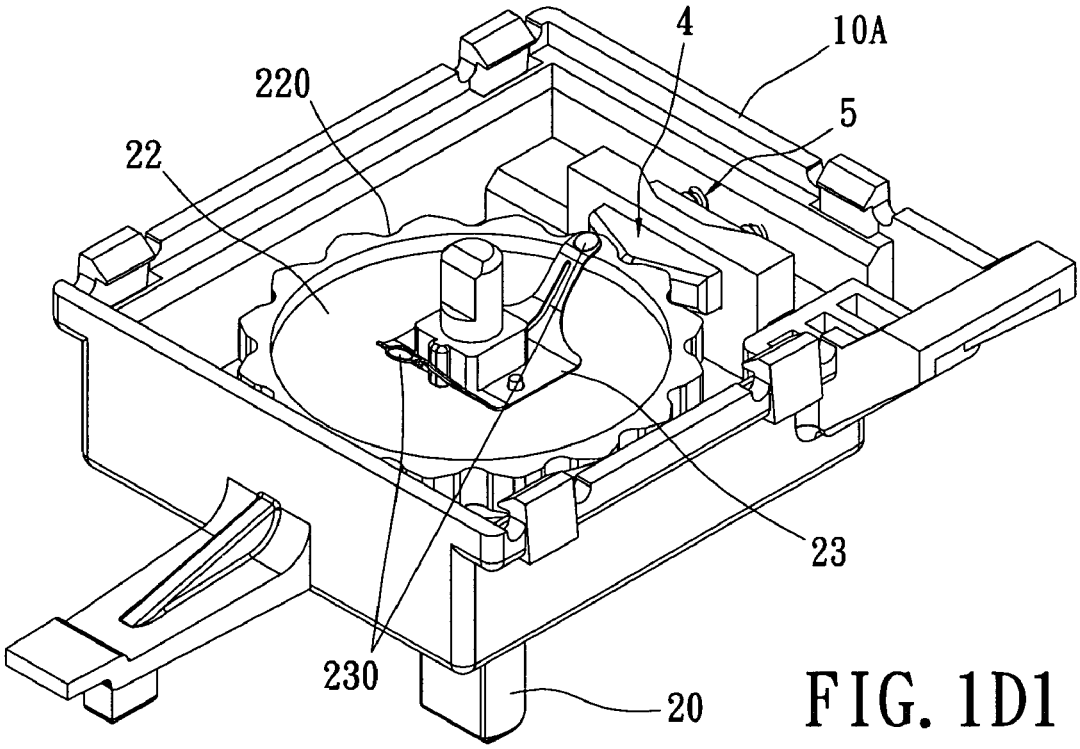
FIG. 1D1
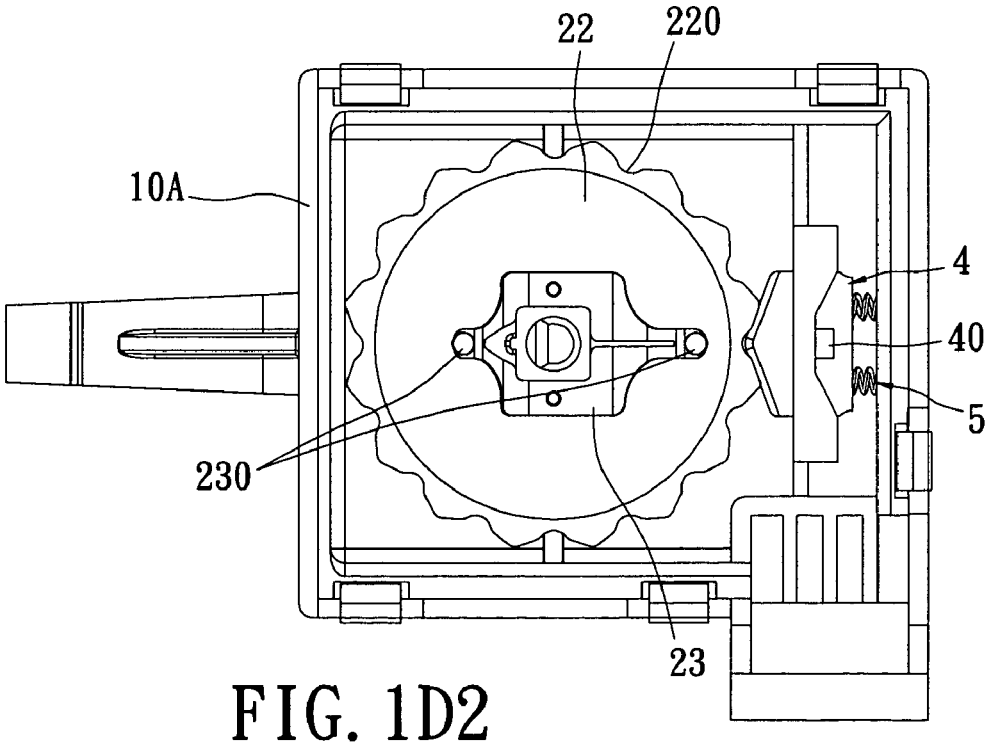
FIG. 1D2

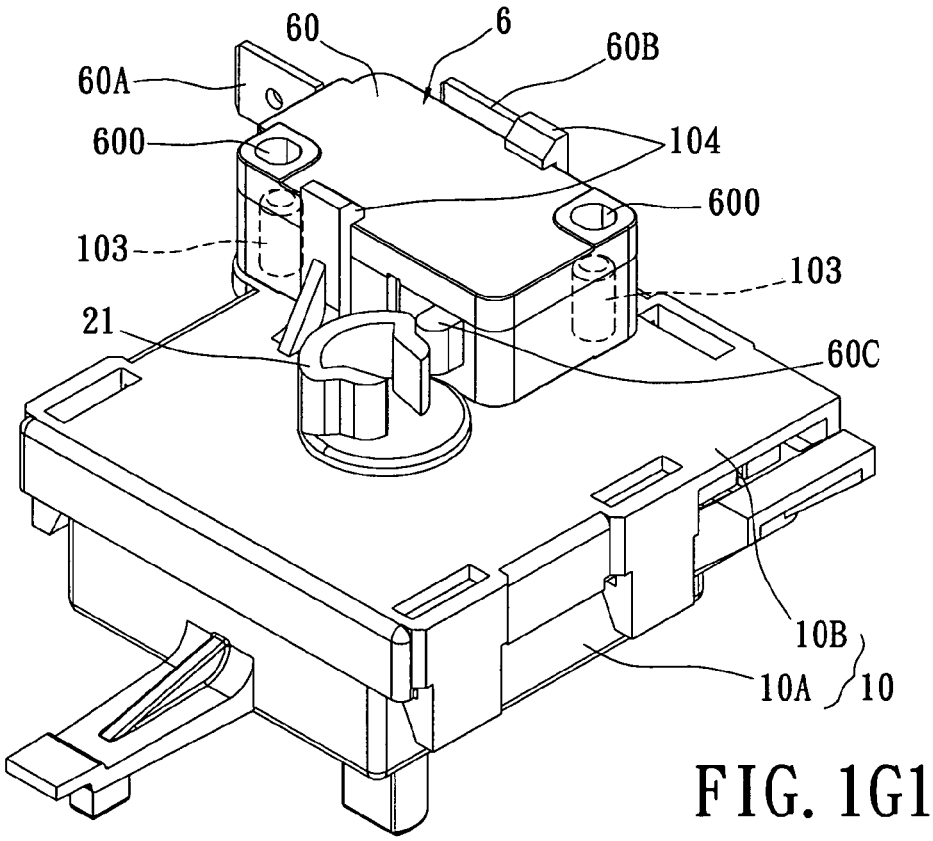
FIG. 1G1
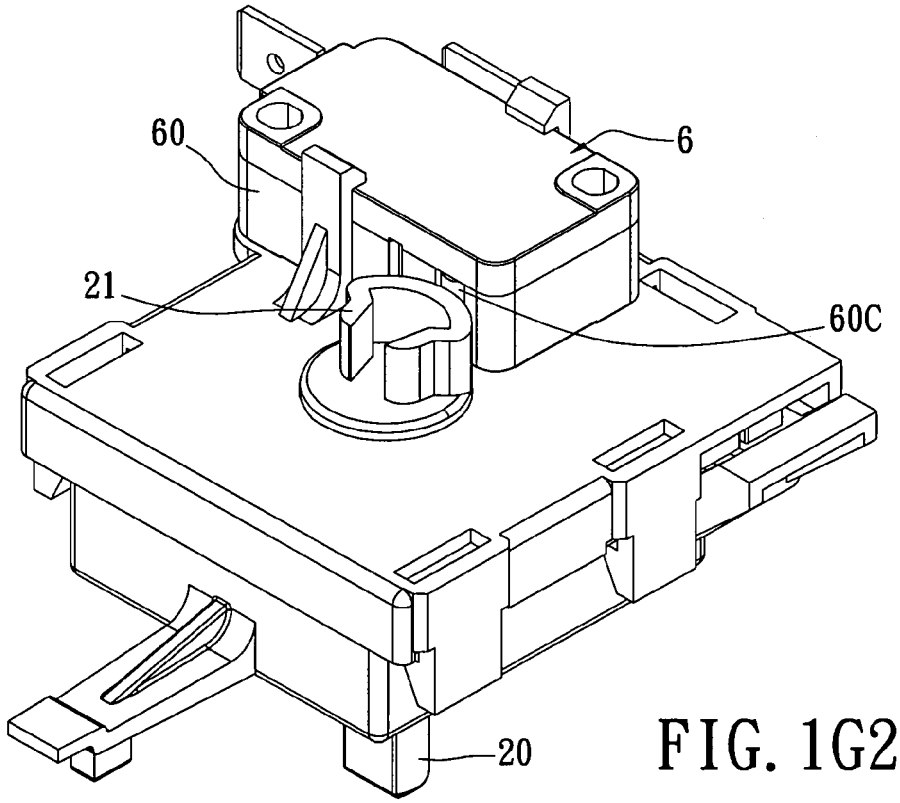
FIG. 1G2

ROTARY COMBINED SWITCH STRUCTURE WITH MULTISTAGE SWITCH FUNCTION

BACKGROUND OF THE INVENTION

1. Field of the Invention

The present invention relates to rotary switch structure, and particularly relates to a rotary combined switch structure with multistage switch function.

2. Description of Related Art

Rotary switches are often applied to electric equipment, especially for electric equipment with multistage functions, such as electric fans, lamps, washing machines etc. In addition, rotary switches can switch between multistage functions of the electric equipment by using an adjust button of the rotary switch.

However, the rotary switch of the prior art can generate the multistage switch function only, and the rotary switch cannot drive another switch to generate another switch function. Hence, the rotary switch of the prior art cannot generate combined function.

SUMMARY OF THE INVENTION

One particular aspect of the present invention is to provide a rotary combined switch structure with multistage switch function. The rotary combined switch structure may generate more than two combined functions by using a rotary unit, so that the rotary unit may control more than two switches at the same time.

In order to achieve the above-mentioned aspects, the present invention provides a rotary combined switch structure with multistage switch function, including: a casing unit, a switch unit and a rotary unit. The casing unit has a casing, a first opening formed on a top side of the casing and a second opening formed on a bottom side of the casing. The switch unit is disposed under the casing. The rotary unit has a rotary body. The rotary body has a top portion passing through the first opening and exposed above the casing, and the rotary body has a bottom portion passing through the second opening and exposed under the casing in order to selectably turn on or turn off the switch unit.

Therefore, a user can rotate the rotary body in order to rotate a conductive piece and a cam at the same time, so that (1) the conductive piece is selectably electrically connected between two of conductive areas in the casing in order to provide different switch functions by using two conductive protrusions; and (2) the cam is rotatable for selectably turning on or turning off the switch unit.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objectives and advantages of the present invention will be more readily understood from the following detailed description when read in conjunction with the appended drawings, in which:

FIG. 1D1 is a partial perspective, assembled, schematic view of a rotary combined switch structure without a substrate, a lower casing and a switch unit according to the first embodiment of the present invention;

FIG. 1D2 is a partial bottom, assembled, schematic view of a rotary combined switch structure without a substrate, a lower casing and a switch unit according to the first embodiment of the present invention;

FIG. 1G1 is a perspective, assembled, schematic view of a rotary combined switch structure (before a cam presses a button portion) according to the first embodiment of the present invention;

FIG. 1G2 is a perspective, assembled, schematic view of a rotary combined switch structure (after a cam presses a button portion) according to the first embodiment of the present invention;

DETAILED DESCRIPTION OF THE PREFERRED EMBODIMENTS

Figure 1A:
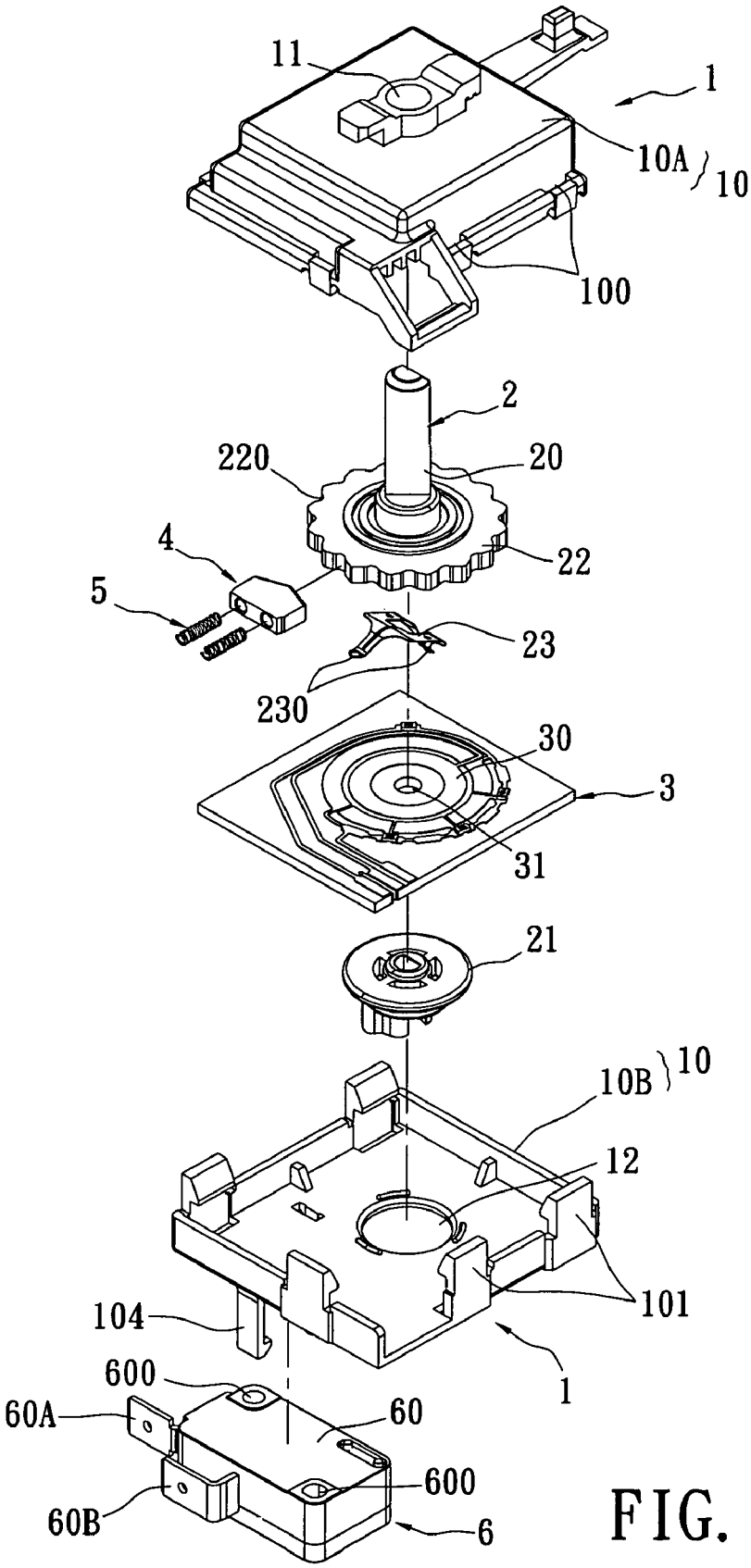
FIG. 1A is one perspective, exploded, schematic view of a rotary combined switch structure according to the first embodiment of the present invention.

Referring to FIGS. 1A to 1G2, the first embodiment of the present invention provides a rotary combined switch structure with multistage switch function, including: a casing unit 1, a rotary unit 2, a substrate 3, rotary retaining element 4, two flexible elements 5 and a switch unit 6.

Figure 1B:
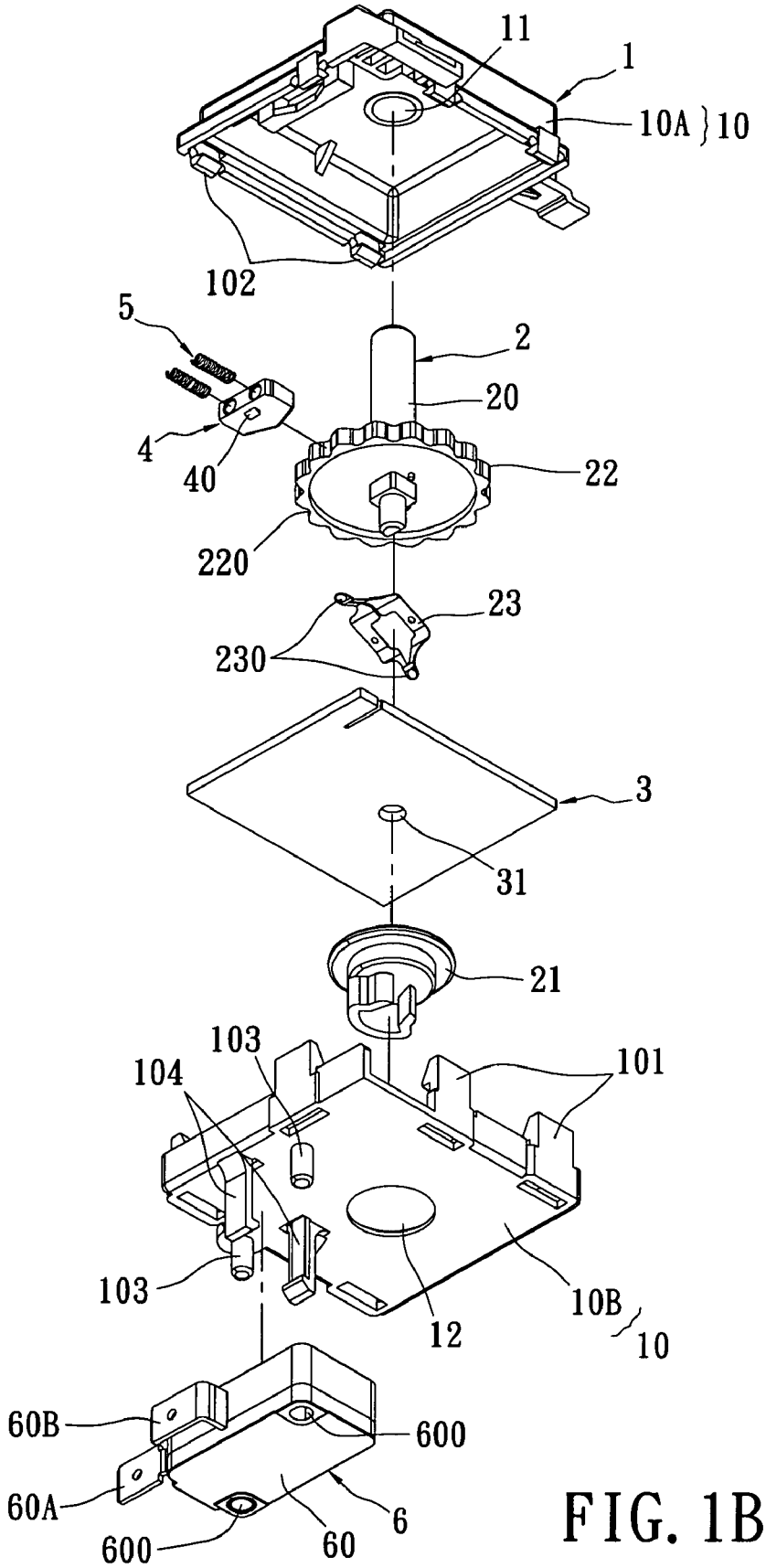
FIG. 1B is another perspective, exploded, schematic view of a rotary combined switch structure according to the first embodiment of the present invention.
Figure 1C:
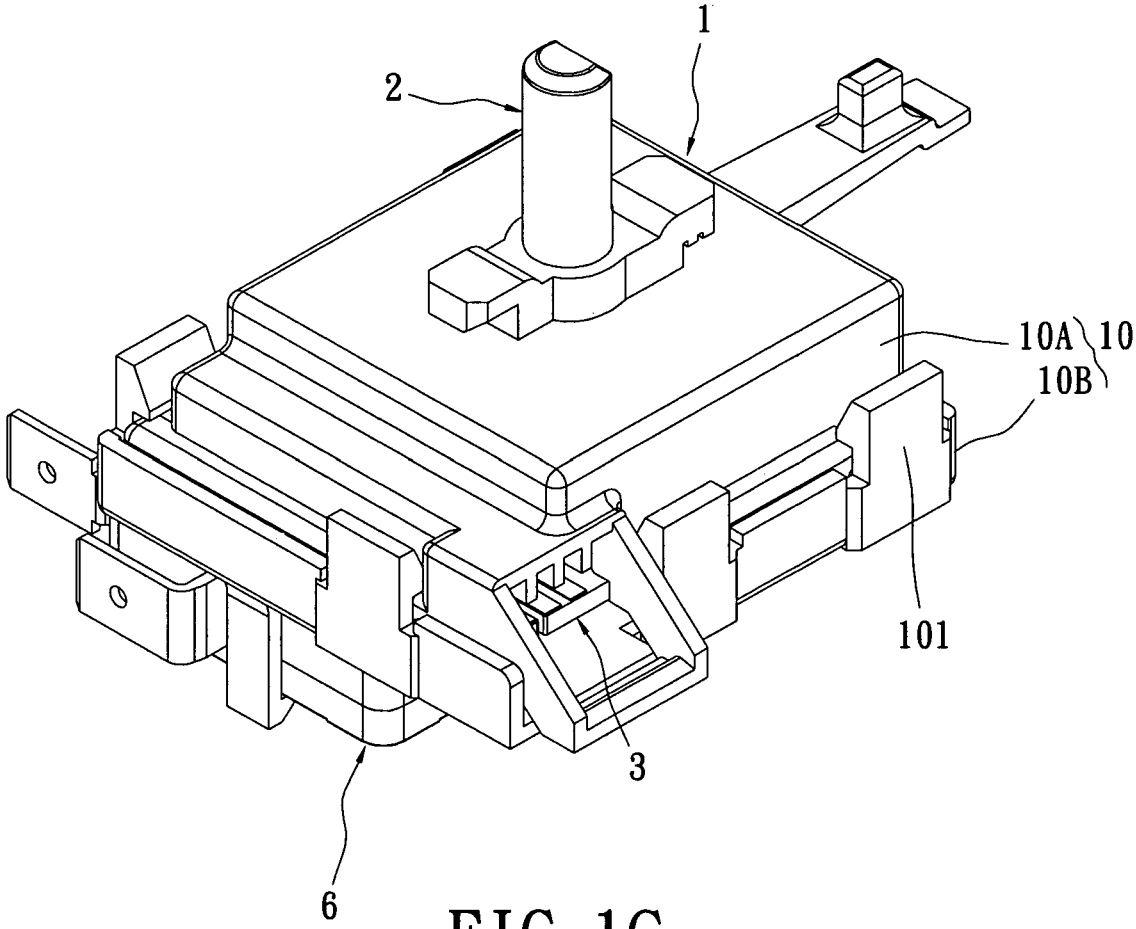
FIG. 1C is a perspective, assembled, schematic view of a rotary combined switch structure according to the first embodiment of the present invention.

Referring to FIGS. 1A to 1C again, the casing unit 1 has a casing 10, a first opening 11 formed on a top side of the casing 10 and a second opening 12 formed on a bottom side of the casing 10. The casing 10 is composed of an upper casing 10A and a lower casing 10B. The first opening 11 is formed on one part of a top surface of the upper casing 10A, and other part of the top surface of the upper casing 10A is sealed. In addition, the upper casing 10A has a plurality of retaining grooves 100 formed around its outer side, the lower casing 10B has a plurality of retaining portions 101 corresponding to the retaining grooves 100 and disposed around its outer side. The upper casing 10A and the lower casing 10B are assembled together by matching the retaining portions 101 and the retaining grooves 100.

However, "the casing 10 composed of an upper casing 10A and a lower casing 10B" and "the upper casing 10A and the lower casing 10B assembled together by matching the retaining portions 101 and the retaining grooves 100" are just two examples. They do not limit the present invention. For example, the casing may be composed of more than two casing portions, and the casing portions may be combined by any method.

Figure 1E:
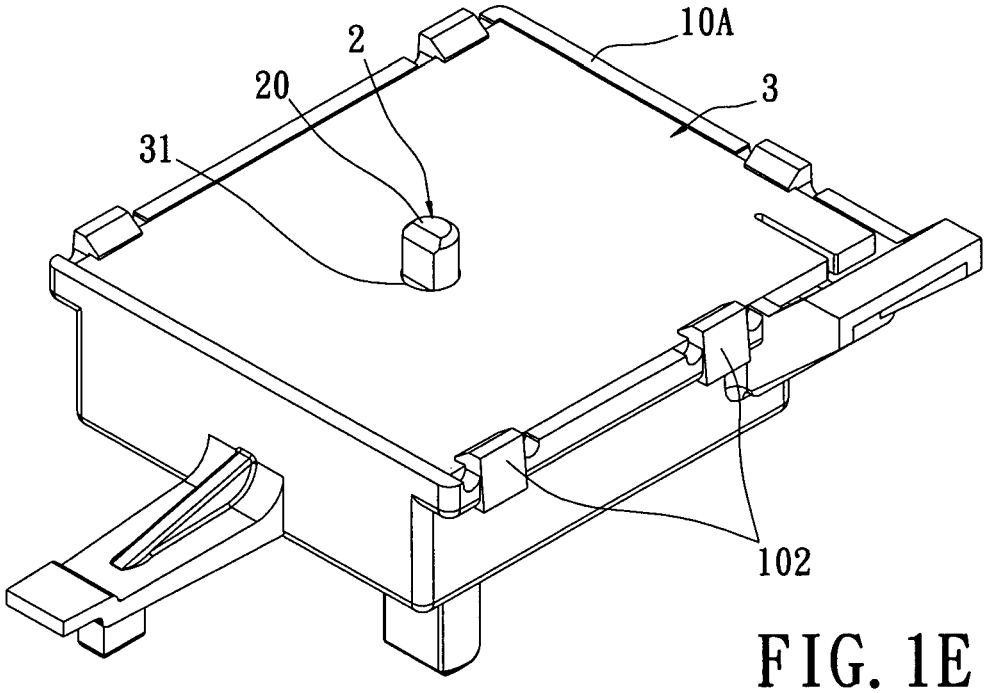
FIG. 1E is a partial perspective, assembled, schematic view of a rotary combined switch structure without a lower casing and a switch unit according to the first embodiment of the present invention.
Figure 1F:
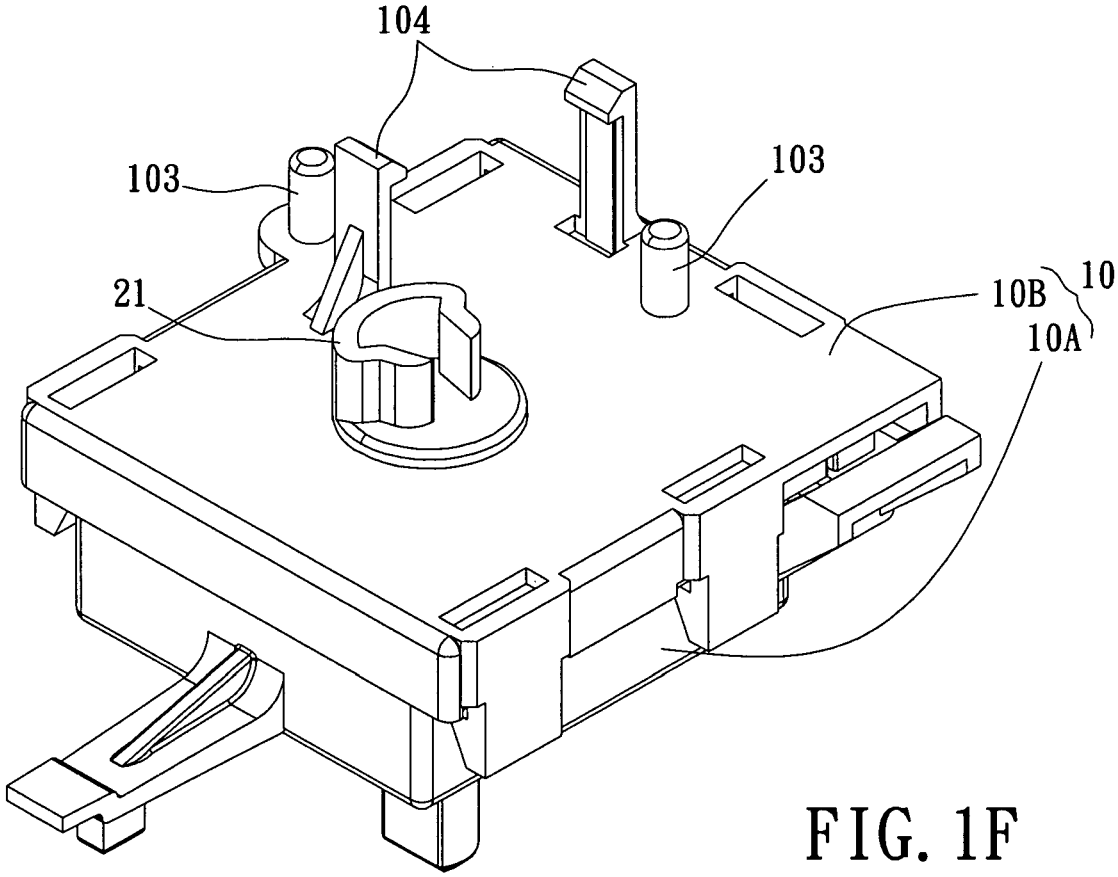
FIG. 1F is a partial perspective, assembled, schematic view of a rotary combined switch structure without a switch unit according to the first embodiment of the present invention.

Referring to FIGS. 1A, 1B, 1D1, 1D2, 1E and 1F again, the rotary unit 2 has a rotary body 20. The rotary body 20 has a top portion passing through the first opening 11 and being exposed above the upper casing 10A. The rotary unit 2 has at least one cam 21 disposed on a bottom portion of the rotary body 20. The cam 21 may be detachably disposed or integrated formed on the bottom portion of the rotary body 20. In other words, the cam 21 may be the bottom portion of the rotary body 20, so that the bottom portion (the cam 21) of the rotary body 20 passes through the second opening 12 and is exposed under the lower casing 10B (as shown in FIG. 1F). In addition, the rotary unit 2 has a rotary disk 22 disposed at a middle portion of the rotary body 20 and a conductive piece 23 disposed under the rotary disk 22. The rotary disk 22 has a plurality of rotary grooves 220 formed around its outer side. The conductive piece 23 has at least two conductive protrusions 230.

Moreover, the substrate 3 is disposed in the casing 10. In the first embodiment, the substrate 3 is retained in the upper casing 10A by many hookings 102 of the upper casing 10A (as shown in FIG. 1E). In addition, the substrate 3 has a plurality of conductive areas 30 formed on a top surface thereof and at least one hole 31 passing therethrough. The two conductive protrusions 230 are selectably electrically connected between two of the conductive areas 30 in order to provide different switch functions. The rotary body 20 passes through the hole 31 in order to contact with the cam 21 (as shown in FIGS. 1E and 1F).

Furthermore, the rotary retaining element 4 and the two flexible elements 5 are disposed in the casing 10. The rotary retaining element 4 has at least one retaining block 40, and the rotary retaining element 4 is restricted in the casing 10 by the retaining block 40. The two flexible elements 5 are disposed between the rotary retaining element 4 and an inner surface of the upper casing 10A of the casing 10. In addition, the rotary retaining element 4 has a front side selectably received in one of the rotary grooves 220 in order to position the rotary unit 2 (as shown in FIGS. 1D1 and 1D2). In other words, the two flexible elements 5 provide force onto the rotary retaining element 4, so that the front side of the rotary retaining element 4 can be selectably received in one of the rotary grooves 220 in order to position the cam 21, the rotary disk 22 and the conductive piece 23.

Of course, the present invention may uses only one flexible element 5 disposed between the rotary retaining element 4 and the inner surface of the upper casing 10A (or more than two flexible elements 5 may be disposed between the rotary retaining element 4 and the inner surface of the upper casing 10A). Hence, when the rotary disk 22 does not be rotated, the rotary retaining element 4 is restricted in the upper casing 10A of the casing 10 by matching the retaining block 40 and one or more than one flexible element 5.

Referring to FIGS. 1A to 1C, 1F, 1G1 and 1G2 again, the switch unit 6 is disposed under the upper casing 10B of the casing 10. In the first embodiment, the switch unit 6 has at least one switch element 60, and the switch element 60 has at least two electrode portions (60A, 60B) and a button portion 60C for selectably electrically connecting the two electrode portions (60A, 60B) to each other or insulating the two electrode portions (60A, 60B) from each other. In addition, the switch element 60 has at least two through holes 600. The upper casing 10B of the casing 10 has at least two positioning posts 103 disposed on its bottom side and at least two retaining elements 104 disposed on its bottom side. The two positioning posts 103 respectively pass through the two through holes 600 in order to position the switch element 60 under the upper casing 10B of the casing 10, and the switch element 60 is retained between the two retaining elements 104.

Therefore, the cam 21 is rotatable for selectably pressing or releasing the button portion 60C in order to selectably turn on or turn off the switch element 60 (as shown in FIGS. 1G1 and 1G2). In other words, a user can rotate the rotary body 20 in order in order to rotate the conductive piece 23 and the cam 21 at the same time, so that (1) the conductive piece 23 is selectably electrically connected between two of the conductive areas 30 in order to provide different switch functions by using the two conductive protrusions 230; and (2) the cam 21 is rotatable for selectably pressing or releasing the button portion 60C in order to selectably turn on or turn off the switch element 60.

Figure 2B:
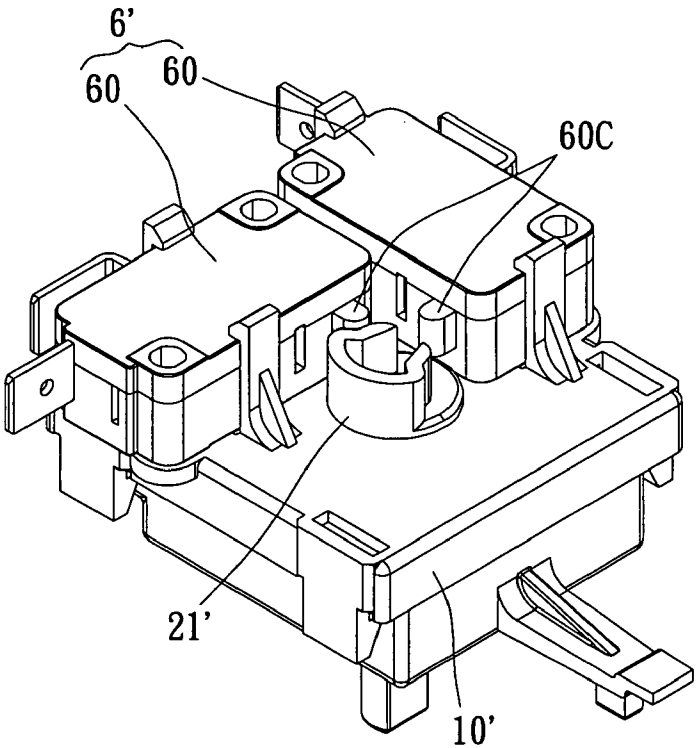
FIG. 2B is a perspective, assembled, schematic view of a rotary combined switch structure according to the second embodiment of the present invention.
Figure 2A:
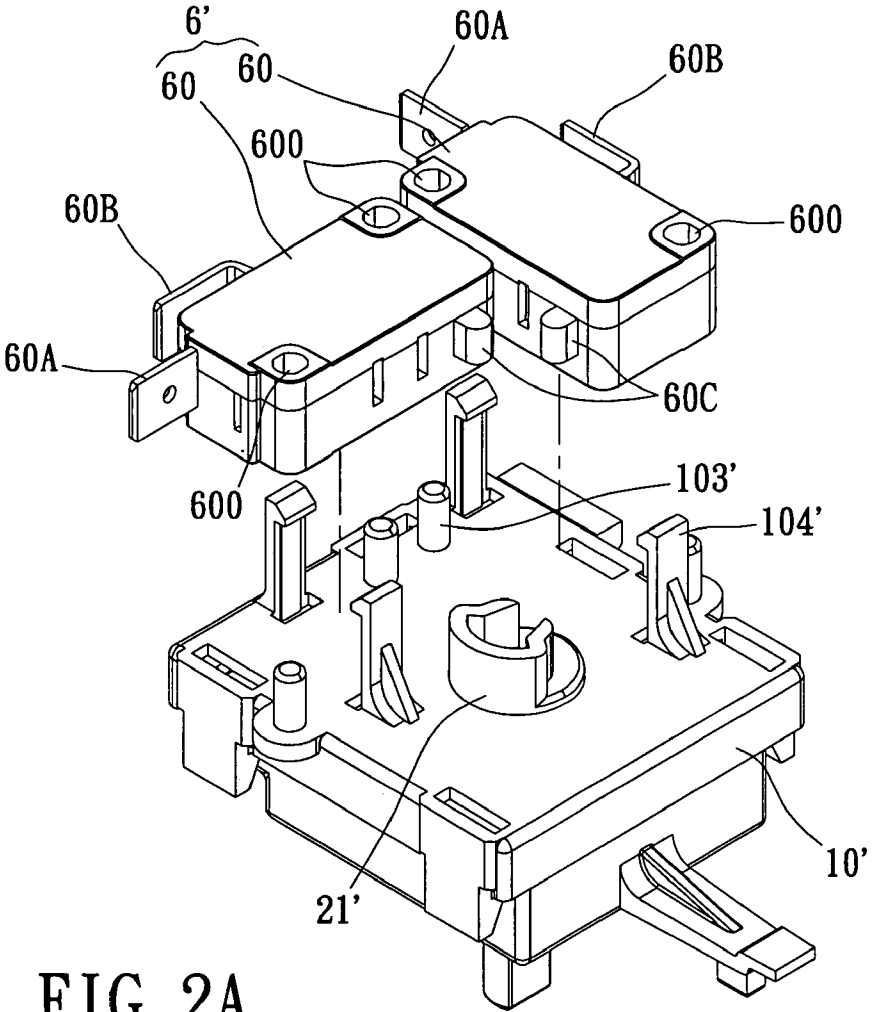
FIG. 2A is a partial perspective, exploded, schematic view of a rotary combined switch structure according to the second embodiment of the present invention.

Referring to FIGS. 2A and 2B, the difference between the second embodiment and the first embodiment is that: in the second embodiment, the switch unit 6' has at least two switch elements 60 separated from each other. Each switch element 60 has at least two electrode portions (60A, 60B) and a button portion 60C for selectably electrically connecting the two electrode portions (60A, 60B) to each other or insulating the two electrode portions (60A, 60B) from each other.

In addition, each switch element 60 has at least two through holes 600. The casing 10' has at least four positioning posts 103' disposed on its bottom side and at least four retaining elements 104' disposed on its bottom side. The four positioning posts 103' respectively pass through the four through holes 600 of the two switch elements 60 in order to position the two switch elements 60 under the casing 10', and each switch element 60 is retained between two of the retaining elements 104'. Hence, the cam 21' is rotatable for selectably pressing or releasing the two button portion 60C in order to selectably turn on or turn off the two switch elements 60.

Figure 3B:
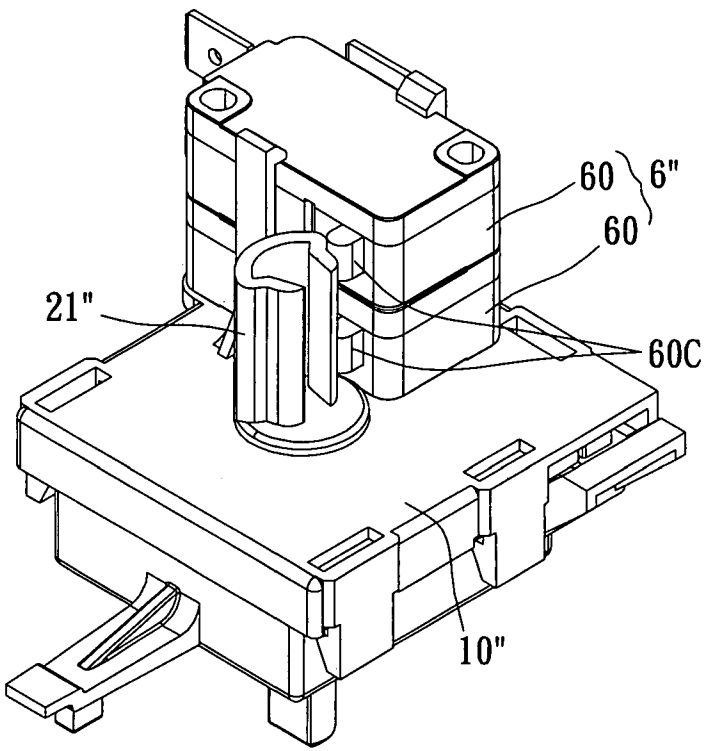
FIG. 3B is a perspective, assembled, schematic view of a rotary combined switch structure according to the third embodiment of the present invention.
Figure 3A:
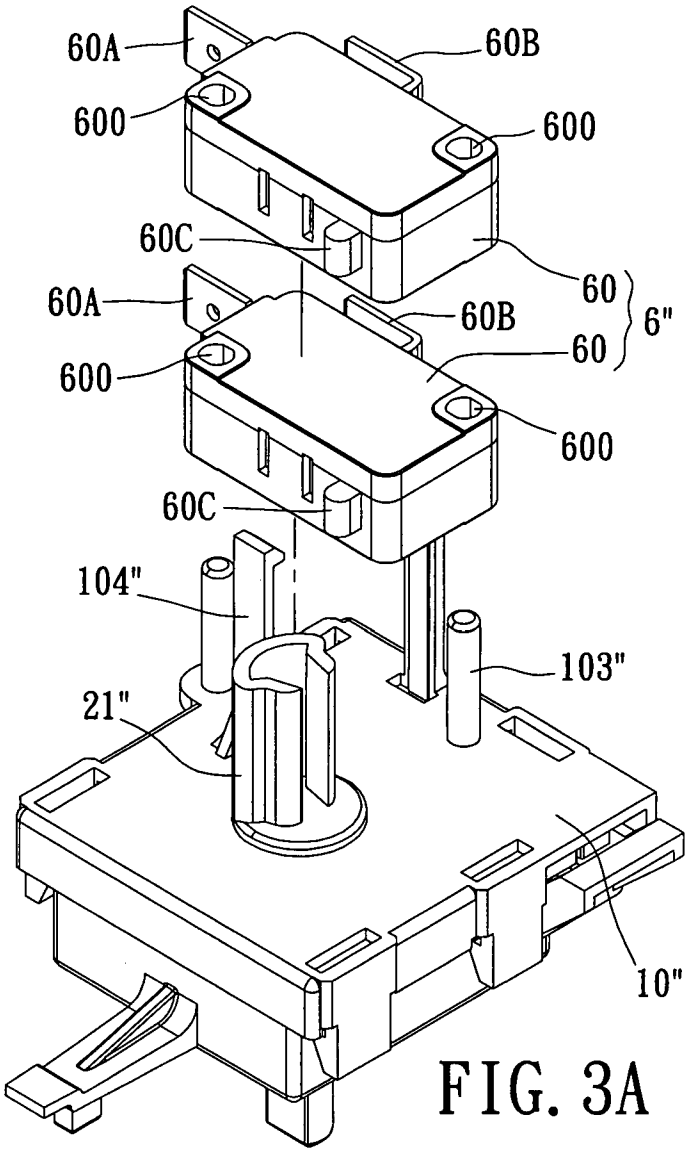
FIG. 3A is a partial perspective, exploded, schematic view of a rotary combined switch structure according to the third embodiment of the present invention.

Referring to FIGS. 3A and 3B, the difference between the third embodiment and the second embodiment is that: in the third embodiment, the switch unit 6" has at least two switch elements 60 stacked onto each other. Each switch element 60 has at least two electrode portions (60A, 60B) and a button portion 60C for selectably electrically connecting the two electrode portions (60A, 60B) to each other or insulating the two electrode portions (60A, 60B) from each other.

In addition, each switch element 60 has at least two through holes 600. The casing 10" has at least two positioning posts 103" disposed on its bottom side and at least two retaining elements 104" disposed on its bottom side. The two positioning posts 103" respectively pass through the two through holes 600 of each switch element 60 in order to position the two switch elements 60 under the casing 10", and the two switch elements 60 are retained between the two retaining elements 104" at the same time. Hence, the cam 21" is rotatable for selectably pressing or releasing the two button portion 60C in order to selectably turn on or turn off the two switch elements 60 at the same time.

However, above-mentioned number of the switch element 60 and above-mentioned arrangement method of the switch element 60 are just examples. They do not limit the present invention.

In conclusion, the user can rotate the rotary body 20 in order in order to rotate the conductive piece 23 and the cam 21 at the same time, so that (1) the conductive piece 23 is selectably electrically connected between two of the conductive areas 30 in order to provide different switch functions by using the two conductive protrusions 230; and (2) the cam 21 is rotatable for selectably pressing or releasing the button portion 60C in order to selectably turn on or turn off the switch element 60.

Although the present invention has been described with reference to the preferred best molds thereof, it will be understood that the present invention is not limited to the details thereof. Various substitutions and modifications have been suggested in the foregoing description, and others will occur to those of ordinary skill in the art. Therefore, all such substitutions and modifications are intended to be embraced within the scope of the present invention as defined in the appended claims.

What is claimed is:

1. A rotary combined switch structure with multistage switch function, comprising:

a housing unit having a housing, a first opening formed on a top side of the housing and a second opening formed on a bottom side of the housing, the housing further including at least two positioning posts and at least two retaining elements disposed on the bottom side;

a switch unit disposed under the housing, the switch unit including at least one switch element which has at least two electrode portions and a button portion for selectably electrically connecting the two electrode portions to each other and insulating the two electrode portions from each other, and the switch element further includes at least two through holes, the two positioning posts respectively pass through the two through holes in order to position the switch element under the housing, and the switch element is retained between the two retaining elements; and a rotary unit having a rotary body, wherein the rotary body has a top portion passing through the first opening and exposed above the housing, and the rotary body has a bottom portion passing through the second opening and exposed under the housing in order to selectably turn on or turn off the switch unit.

2. The rotary combined switch structure as claimed in claim 1, wherein the rotary unit has at least one cam disposed on the bottom portion of the rotary body, and the cam is rotatable for selectably pressing or releasing the button portion in order to selectably turn on or turn off the switch element.

3. The rotary combined switch structure as claimed in claim 1, wherein the housing is composed of an upper housing and a lower housing.

4. The rotary combined switch structure as claimed in claim 3, wherein a top surface of the upper housing is a sealed surface, and the first opening is formed on the top surface.

5. The rotary combined switch structure as claimed in claim 3, wherein the upper housing has a plurality of retaining grooves formed around its outer side, the lower housing has a plurality of retaining portions corresponding to the retaining grooves and disposed around its outer side, and the upper housing and the lower housing are assembled together by matching the retaining portions and the retaining grooves.

6. The rotary combined switch structure as claimed in claim 1, wherein the switch unit has at least two switch elements separated from each other, and each switch element has at least two electrode portions and a button portion for selectably electrically connecting the two electrode portions to each other or insulating the two electrode portions from each other.

7. The rotary combined switch structure as claimed in claim 6, wherein the rotary unit has at least one cam disposed on the bottom portion of the rotary body, and the cam is rotatable for selectably pressing or releasing the button portion in order to selectably turn on or turn off the two switch elements.

8. The rotary combined switch structure as claimed in claim 6, wherein each switch element has at least two through holes, the housing has at least four positioning posts disposed on its bottom side and at least four retaining elements disposed on its bottom side, the four positioning posts respectively pass through the four through holes of the two switch elements in order to position the two switch elements under the housing, and each switch element is retained between two of the retaining elements.

9. The rotary combined switch structure as claimed in claim 1, wherein the switch unit has at least two switch elements stacked onto each other, and each switch element has at least two electrode portions and a button portion for selectably electrically connecting the two electrode portions to each other or insulating the two electrode portions from each other.

10. The rotary combined switch structure as claimed in claim 9, wherein the rotary unit has at least one cam disposed on the bottom portion of the rotary body, and the cam is rotatable for selectably pressing or releasing the button portion in order to selectably turn on or turn off the two switch elements at the same time.

11. The rotary combined switch structure as claimed in claim 9, wherein each switch element has at least two through holes, the housing has at least two positioning posts disposed on its bottom side and at least two retaining elements disposed on its bottom side, the two positioning posts respectively pass through the two through holes of each switch element in order to position the two switch elements under the housing, and the two switch elements are retained between the two retaining elements at the same time.

12. The rotary combined switch structure as claimed in claim 1, further comprising: a substrate, a rotary retaining element and at least one flexible element, wherein the substrate, the rotary retaining element and the flexible element are disposed in the housing, the substrate has a plurality of conductive areas formed on a top surface thereof and at least one hole passing therethrough, the rotary retaining element has at least one retaining block, the flexible element is disposed between the rotary retaining element and an inner surface of the housing, and the rotary retaining element is restricted in the housing by matching the retaining block and the flexible element.

13. The rotary combined switch structure as claimed in claim 12, wherein the rotary unit has a rotary disk disposed at a middle portion of the rotary body and a conductive piece disposed under the rotary disk, the rotary disk has a plurality of rotary grooves formed around its outer side, the rotary retaining element has a front side selectably received in one of the rotary grooves in order to position the rotary unit, the conductive piece has at least two conductive protrusions selectably electrically connected between two of the conductive areas.

* * * * *